US008906483B2

(12) United States Patent
Bonanno et al.

(10) Patent No.: US 8,906,483 B2
(45) Date of Patent: Dec. 9, 2014

(54) FLAT TEXTILE ARTICLE WITH MAGNET IN EDGE

(71) Applicants: Vincenzo Bonanno, Friedrichsdorf (DE); Daniel Greco-Ahmadiyan, Friedrichsdorf (DE)

(72) Inventors: Vincenzo Bonanno, Friedrichsdorf (DE); Daniel Greco-Ahmadiyan, Friedrichsdorf (DE)

( * ) Notice: Subject to any disclaimer, the term of this patent is extended or adjusted under 35 U.S.C. 154(b) by 283 days.

(21) Appl. No.: 13/626,217

(22) Filed: Sep. 25, 2012

(65) Prior Publication Data

US 2013/0156980 A1 Jun. 20, 2013

(30) Foreign Application Priority Data

Dec. 19, 2011 (DE) ..... 20 2011 109 165 U

(51) Int. Cl.

| | |
|---|---|
| ***B32B 3/04*** | (2006.01) |
| ***B32B 3/06*** | (2006.01) |
| ***B32B 3/08*** | (2006.01) |
| ***A47K 10/02*** | (2006.01) |

(52) U.S. Cl.
USPC ..... 428/99; 428/122

(58) Field of Classification Search
CPC ..... B32B 3/04; B32B 3/06; B32B 3/08; A47K 10/02
USPC ..... 428/99, 122, 900; 15/209.1; 24/303
See application file for complete search history.

(56) References Cited

FOREIGN PATENT DOCUMENTS

| | | |
|---|---|---|
| DE | 20013553 U | 3/2001 |
| DE | 202010016356 U | 4/2011 |

*Primary Examiner* — Alexander Thomas
(74) *Attorney, Agent, or Firm* — Andrew Wilford

(57) ABSTRACT

An article has a panel of textile having an outer edge formed with a cutout. A permanent magnet is held in the cutout between a pair of flaps of a flexible material significantly more durable than the textile of the panel. The flaps flank the magnet, close the cutout, and overlapping the panel around the cutout. These flaps are secured by stitching or the like to the panel around the cutout to form the flaps into a pocket containing the magnet.

10 Claims, 2 Drawing Sheets

Fig. 1
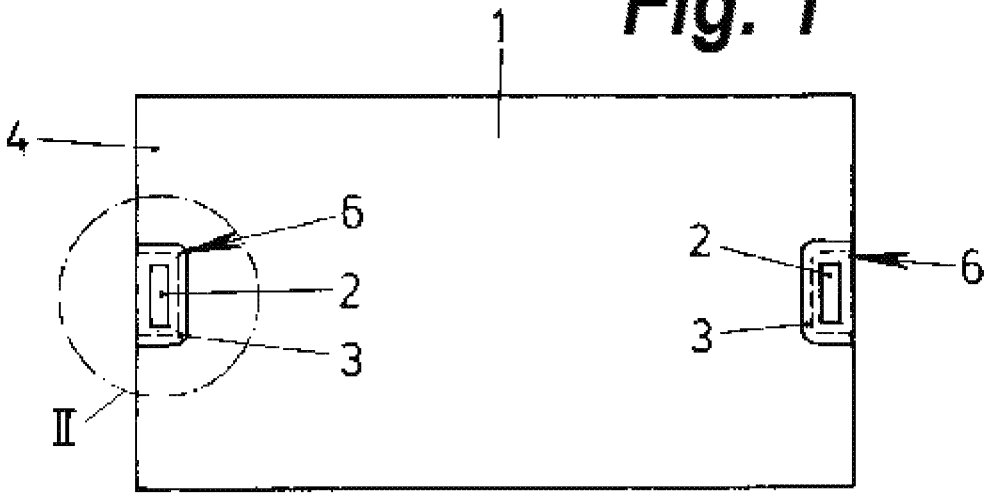
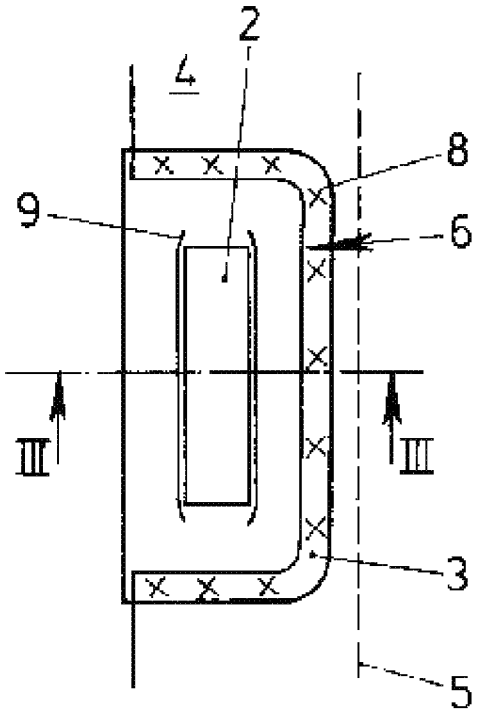
Fig. 2

FLAT TEXTILE ARTICLE WITH MAGNET IN EDGE

FIELD OF THE INVENTION

The present invention relates to a flat textile article with a magnet in its edge. More particularly this invention concerns a hand towel with a magnet in its short edge.

BACKGROUND OF THE INVENTION

A textile article of this type, in particular a towel, is described in DE 20 2010 016 356. A magnet is held in one of the short sides of the towel. This makes it possible to attach the towel, e.g. in gyms to the seat areas of training equipment with a metal base frame. This patent document further proposes sewing the magnet or magnets into the hem of the towel. A similar suggestion is also found, for example in DE 200 13 553.

In principle, this type of attachment is easy to realize and also ensures an adequate hold of the towel on a metallic base surface. However, it has been shown that an attachment of this type is not very durable, since when the towel is washed, the sewn-in magnet knocks against the hem and soon destroys the fabric with its edges. Therefore this type of attachment is not suitable for textile articles such as towels that have to be washed often.

OBJECTS OF THE INVENTION

It is therefore an object of the present invention to provide an improved flat textile article with a magnet in its edge.

Another object is the provision of such an improved flat textile article with a magnet in its edge that overcomes the above-given disadvantages, in particular that is durable and wash-resistant.

SUMMARY OF THE INVENTION

An article has according to the invention a panel of textile having an outer edge formed with a cutout. A permanent magnet is held in the cutout between a pair of flaps of a flexible material significantly more durable than the textile of the panel. The flaps flank the magnet, close the cutout, and overlapping the panel around the cutout. These flaps are secured by stitching or the like to the panel around the cutout to form the flaps into a pocket containing the magnet.

This arrangement makes it possible to make the tabs from a material that is more rugged than the textile article itself, so that the movements of the magnet inside the pocket during washing do not lead to destruction of the tab. The magnet is thus held permanently in the towel so that the towel survives washing many times undamaged.

Preferably, the tab is formed from one piece and folded into two identical halves or flaps. The tab is pushed over the edge of the towel so its two halves come to rest opposite sides or faces of the towel and thereby cover and close the cutout on both sides. In principle, the tab could also be formed by two parts are placed on both sides of the towel on the cutout to cover and close it.

The cutout can be produced in a particularly simple manner if it is designed to be open outwardly at the edge of the panel. For example, it can be punched or cut out of the edge of the textile panel.

The magnet is elongated and has a square cross section and thus four edge surfaces and two opposite faces, the one magnetic pole being at one of the faces and the other magnetic pole is located in the opposite face. Since the faces are flat, there is always a large contact surface available for the metallic substrate so that the magnetic holding forces are very high.

Furthermore the magnet is encased in a shrink film that covers at least the sides edges of the magnet. This has two advantages: on the one hand the magnet can more easily rotate about its longitudinal axis due to the smooth surface of the shrink film, so that it always comes to rest on the metallic substrate with a face that forms a pole of the magnet. Furthermore, the poles of the magnets that are on opposite edges of the textile article can be aligned to one another when the two magnets are brought together in order to form a ring or a loop from the textile article.

On the other hand, the shrink film also covers the ends of the magnet, so that knocking of the magnet ends on the inside of the tab during washing are damped or distributed over a larger surface. In the simplest case, the shrink film is a heat-shrunk sleeve that is pulled over the magnet and which then is shrunk by heat, the longitudinal extension of the heat-shrunk sleeve being greater than that of the magnet, so that in any case the ends of the front faces to the lateral surfaces are covered.

A further measure that is used to keep the stress on the tab as low as possible during washing, lies in selecting the length of the extension such that the magnet can shift longitudinally in the cutout. This prevents the edges, in particular between the front face and the lateral surfaces, from always engaging the same place on the tab during washing.

The tab is preferably made of an aramid fabric. This is very strong but nevertheless has a relatively smooth surface, so that on the one hand the magnet can rotate about its longitudinal axis unhindered in the interior of the tab, and on the other hand the outer surface of the tab gives a pleasant impression in terms of touch.

Preferably, the magnet is a neodymium magnet. Furthermore, the invention relates to a towel, a magnet is arranged in the center region if each of the two short edges of the towel.

BRIEF DESCRIPTION OF THE DRAWING

The above and other objects, features, and advantages will become more readily apparent from the following description, reference being made to the accompanying drawing in which:

FIG. 1 is a top view of a towel according to the invention;

FIG. 2 is a large-scale view of the detail indicated at II in FIG. 1;

DETAILED DESCRIPTION

Figure 3:
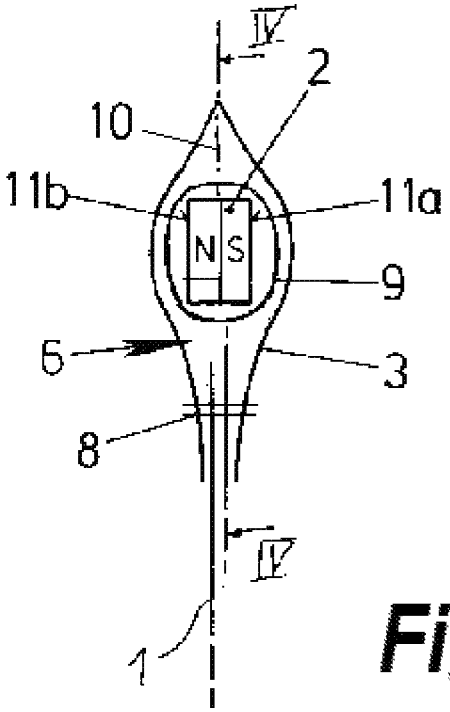
FIG. 3 is a section along the line of FIG. 2.

The invention can be applied to any type of textile article, but is preferably to be used for towels, so that a towel is described below as an illustrated embodiment.

FIG. 1 shows a special rectangularly elongated panel or towel 1 on whose short sides or ends 4 magnets 2 are in tabs 3. This is shown in an enlarged manner in FIG. 2 for one of the magnets 2. The edge 4 of the towel 1 has a hem 5 whose edge is shown by a dashed line. The edge 4 has an outwardly open generally rectangular cutout 6 that is either cut or punched out of the hem 5. The cutout 6 extends longitudinally parallel to the edge of the towel and extends fully between the opposite faces of the towel 1.

The cutout 6 is covered on both sides by flaps of a tab 3. This tab 3 is folded so that its two flaps or halves lie opposite one another. Each half is somewhat larger than the cutout 6, so that their outer edges come to rest on opposite sides of the towel 1 on the edge of the cutout 6 and are there sewn to the towel 1 along a seam 8 so that a closed pocket is formed. The magnet 2 is held in this pocket, encased by a heat-shrink sleeve 9. The magnet 2 is elongated and extends parallel to the edge of the towel 1. The orientation of the magnet 2 in the pocket is shown in cross section in FIG. 3.

The magnet 2 is of rectangular cross section with its two poles separated along a longitudinal center plane 10. Two opposite lateral faces 11*a* and 11*b* thus respectively form the north and south poles of the magnet 2.

The magnet 2 is encased continuously over its entire length by the heat-shrunk sleeve 9 that is somewhat longer than the magnet 2 so that the longitudinal ends of the magnet 2 are covered by the heat-shrunk sleeve 9. These are rounded a little thereby, so that the magnet 2 can better rotate about its longitudinal axis in the pocket and can thereby be optimally aligned respectively either to a metal surface or to another magnet from which the panel or towel 1 can be hung. The smooth surface of the heat-shrunk sleeve 9 furthermore ensures that friction with respect to the tab 3—as far as the edges bear against it—is as low as possible.

It can further be seen that the seam 8 that attaches the tab 3 to the towel 1 goes through the towel 1, that is, connects the two tab halves or flaps to one another and closes the cutout 6 in the hem 5, with each flap of the tab 3 bearing on a respective face of the towel 1.

Figure 4:
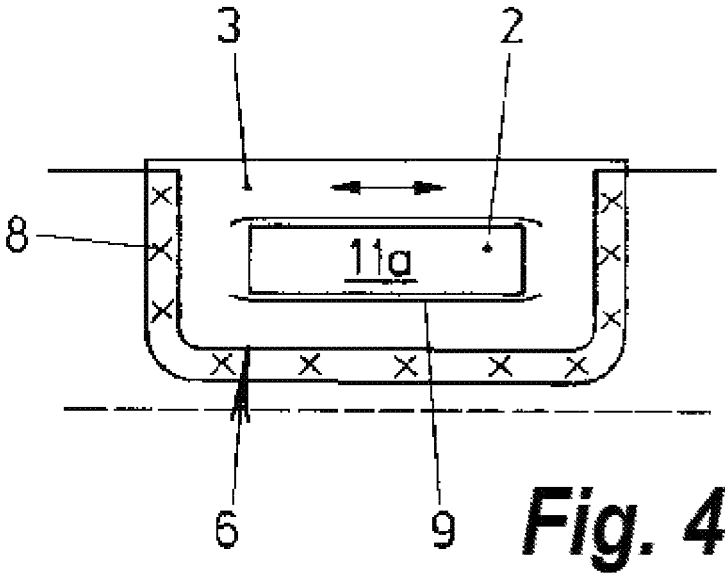
FIG. 4 is a section along the line IV-IV of FIG. 3.

FIG. 4 again shows a longitudinal section through the cutout 6 with the magnet 2. The length of the magnet 2 is somewhat smaller than the length of the cutout 6, so that the magnet 2 and its sleeve 9 can also move longitudinally (see double arrow) inside the pocket formed by the folded tab 3. This is ensures that the magnet 2 does not always knock against the same place on the tab 3 during washing.

Moreover, it can be seen that the heat-shrunk sleeve 9 is somewhat longer than the magnet 2 itself, so that at least the edges between the lateral faces and the front surfaces of the magnet are covered, which facilitates longitudinal displacement of the magnet inside the pocket.

The material of which the tab 3 is made is much more stable and durable than the towel material itself. In particular technical fabrics have proven successful here, in particular, a fabric of aramid fibers has proven to be particularly advantageous.

According to a definition by the Federal Trade Commission, only those long-chain synthetic polyamide are designated as aramids or aromatic polyamide (polyaramides) in which at least 85% of the amid linkages are attached directly to two aromatic rings. Aramid fibers are golden yellow organic synthetic fibers sold i.a. under the trade name Kevlar. These fibers are characterized by a very high strength, high impact resistance, high fracture strain, good vibration damping and resistance to acids and lyes. Moreover, they are very heat- and flame-resistant.

We claim:

1. An article comprising:

a panel of textile having an outer edge formed with a cutout;

a permanent magnet in the cutout;

a pair of flaps of a flexible material significantly more durable than the textile of the panel flanking the magnet, closing the cutout, and overlapping the panel around the cutout; and means securing the flaps to the panel around the cutout to form the flaps into a pocket containing the magnet.

2. The article defined in claim 1, wherein the flaps are unitarily joined at a fold that runs along the edge of the textile panel.

3. The article defined in claim 2 wherein the cutout is outwardly open at the edge.

4. The article defined in claim 1, wherein the magnet is parallepipedal and has four edges and two opposite faces, the magnet being polarized oppositely at the faces.

5. The article defined in claim 1, further comprising:

a shrink sleeve surrounding the magnet and lying between the magnet and the flaps.

6. The article defined in claim 5, wherein the magnet is elongated and the shrink sleeve is longer than the magnet so as to cover ends of the magnet.

7. The article defined in claim 1, wherein the flaps are a woven aramid textile.

8. The article defined in claim 1, wherein the magnet is of neodymium.

9. The article defined in claim 1, wherein the panel has two opposite ends each formed with one of the cutouts in which a respective magnet is held by a respective pair of flaps.

10. A hand towel comprising:

an elongated rectangular and absorbent textile panel having a short end formed with an outwardly open cutout;

a tab of a textile more durable than the textile of the panel and having a pair of flaps joined at a center fold line, each flap covering a respective side of the cutout and engaging a respective face of the panel with the fold line extending along an edge of the panel;

a permanent magnet in the cutout between the flaps;

a heat-shrunk sleeve surrounding the magnet between the flaps; and stitching securing each of the flaps to the respective face of the panel around the cutout.

* * * * *